US008137076B2

(12) United States Patent
Braun

(10) Patent No.: US 8,137,076 B2
(45) Date of Patent: Mar. 20, 2012

(54) METHOD AND SYSTEM FOR RAISING A LIQUID USING A PRESSURISED GAS AND A BUOYANT, MOVABLE INTERFACE MEMBER

(76) Inventor: Francois Braun, Kraainem (BE)

( * ) Notice: Subject to any disclaimer, the term of this patent is extended or adjusted under 35 U.S.C. 154(b) by 850 days.

(21) Appl. No.: 11/886,525

(22) PCT Filed: Mar. 16, 2006

(86) PCT No.: PCT/EP2006/060814

§ 371 (c)(1),
(2), (4) Date: Jun. 18, 2008

(87) PCT Pub. No.: WO2006/097519

PCT Pub. Date: Sep. 21, 2006

(65) Prior Publication Data

US 2009/0047139 A1 Feb. 19, 2009

(30) Foreign Application Priority Data

Mar. 17, 2005 (EP) ..... 05102128

(51) Int. Cl.
*F04F 1/00* (2006.01)
*F04F 3/00* (2006.01)
*F04B 9/08* (2006.01)

(52) U.S. Cl. ..... 417/118; 417/388; 417/53

(58) Field of Classification Search ..... 417/118, 417/383, 385, 386, 388, 390, 392, 53; 166/372, 166/68, 319

See application file for complete search history.

(56) References Cited

U.S. PATENT DOCUMENTS

| | | | | | |
|---|---|---|---|---|---|
| 140,879 | A | * | 7/1873 | Prall | 417/118 |
| 298,990 | A | * | 5/1884 | Leedy | 417/118 |
| 350,761 | A | * | 10/1886 | Neff | 417/118 |
| 583,837 | A | * | 6/1897 | Bechtol | 417/118 |
| 588,825 | A | * | 8/1897 | Haas | 417/118 |
| 751,323 | A | * | 2/1904 | Moran et al. | 417/118 |
| 793,953 | A | * | 7/1905 | Powers | 417/118 |
| 868,487 | A | * | 10/1907 | Rosengarten | 417/118 |
| 1,042,107 | A | * | 10/1912 | Grant | 222/40 |
| 2,014,613 | A | * | 9/1935 | Ceverha | 417/383 |
| 2,152,802 | A | * | 4/1939 | Harris | 417/390 |
| 2,893,325 | A | * | 7/1959 | Roberts | 417/118 |
| 3,161,139 | A | * | 12/1964 | Borelli | 417/53 |

(Continued)

FOREIGN PATENT DOCUMENTS

DE 574 041 C 4/1933

(Continued)

*Primary Examiner* — Devon C Kramer
*Assistant Examiner* — Nathan Zollinger
(74) *Attorney, Agent, or Firm* — Jacobson Holman PLLC

(57) ABSTRACT

A method and a device for extracting a liquid from a liquid pond, wherein in a first phase air is removed from an airtight reservoir, a venting and a rising pipe in order to create depression therein and a suck-up of the liquid in the liquid pond. In a second phase, a distribution device is brought from a first to a second operating position in order to supply pressurized gas to said venting pipe which has an outlet connected to the rising pipe. In a third phase the liquid is pushed from the venting pipe to the rising pipe and thereafter to the reservoir by means of pressurized air and an interface member. In a fourth phase the distribution device is brought back to its first operation position.

15 Claims, 6 Drawing Sheets

U.S. PATENT DOCUMENTS 3,306,216 A * 2/1967 Warman ..... 417/92
3,814,545 A * 6/1974 Waters ..... 417/90
3,991,825 A * 11/1976 Morgan ..... 166/68
5,611,671 A * 3/1997 Tripp, Jr. ..... 417/126
5,806,598 A * 9/1998 Amani ..... 166/372
6,435,838 B1 * 8/2002 Marvel et al. ..... 417/53

FOREIGN PATENT DOCUMENTS

DE 37 10 775 A1 10/1988
WO WO 97/38226 10/1997

* cited by examiner

METHOD AND SYSTEM FOR RAISING A LIQUID USING A PRESSURISED GAS AND A BUOYANT, MOVABLE INTERFACE MEMBER

This is a 371 of PCT/EP2006/060814 filed Mar. 16, 2006.

The present invention relates to a method for extracting a liquid, in particular water, from a liquid pond, wherein pressurised gas is supplied through a venting pipe in order to bring an amount of said liquid via a rising pipe from said liquid pond into a reservoir, situated at a ground level.

The invention also relates to a system for extracting a liquid from a liquid pond.

Such a method and such a system are known from DE-A-37 10775. In the known method and system, pressurised air is supplied via a venting pipe into a small reservoir placed inside the liquid pond. The small reservoir is connected to a rising pipe extending towards a larger reservoir situated at ground level. For this purpose the venting pipe and the rising pipe extend over the whole height between the liquid pond and the ground level. The pressurised air is injected into the water collected inside the small reservoir, at a point below the water level inside the liquid pond. The air injection results into a two-phase mixture of air bubbles and water, which is lighter in specific weight than the water itself. This two-phase mixture is then pushed upwards into the rising pipe by hydrostatic pressure. In such a manner an amount of water is extracted from the liquid pond.

A drawback of the known method and system is that the submergence of the air line and the internal diameter of the rising pipe are rather critical in order to enable a satisfactory functioning. Submergence signifies the depth of the water inlet at the output of the pressurised air below the pumping level. For a satisfactory performance approximately 60% submergence is required. These constraints have as consequence that the known method is only applicable in a satisfactory manner with a deep liquid pond. Furthermore, as the water level in the liquid pond is not constant and even tends to fall down with increasing pumping rate, the required constraints could during pumping no longer be met, thereby considerably reducing the efficiency of the method. Finally as the pressurised air and the collected water are mixed in the underground reservoir and as this mixture is brought to ground level, severe constraints are imposed on the rising pipe, which has to be of reduced diameter, thereby substantially reducing the efficiency of the method.

It should also be noted that it is known to use underground pumps, submersed into the liquid pond, to extract the liquid from the underground liquid pond. Although this method requires less critical constraints than the known air lift method, it has the disadvantage that the pumps are often placed in a corrosive or abrasive environment, which considerably reduces their lifecycle. It is furthermore cumbersome to remove the pump from the liquid pond when it needs to be repaired or when its pumping capacity has to be adjusted to the level of the water pond. Another drawback of submersed pump is that the pump has to sustain and overcome the high pressure resulting from the total water column height, when pumping the water to ground level.

It is an object of the present invention to provide an efficient method and a system for extracting a liquid, in particular water, from a liquid pond, which method is less dependent from the depth of the liquid pond and the liquid level as well as the variations in the liquid pond and where there is no need to place working components inside the liquid pond. Moreover it is an object of the invention to limit the amount of liquid extracted during each operation cycle thereby avoiding the use of high pressure for bringing up the liquid.

For this purpose, a method according to the present invention is characterised in that said reservoir is air tight and said venting pipe has an outlet connected to said rising pipe, and wherein in a first operating position a distribution device, situated at the ground level and to which said rising and venting pipes are separately connected and which is further connected to said reservoir, connects said reservoir to said rising and venting pipes, and wherein air, present into said reservoir and said rising and venting pipes, is removed by means of a pump in order to create within a first phase a depression into said reservoir and said rising and venting pipe, enabling a suction of said amount of said liquid into said rising and venting pipes, in particular through a feeding pipe equipped with a one way valve and extending from said liquid pond towards said rising pipe, and wherein in a second phase said distribution device is brought into a second operating position, where said reservoir is connected to said rising pipe and an inlet of said venting pipe is connected to a supply source of said pressurised gas, in order to enable said supply of said pressurised gas into said venting pipe, and wherein during a third phase said amount of liquid present in said venting pipe being pushed by means of said pressurised gas towards said rising pipe and an interface member, which is floatable on said liquid and movable within said venting and rising pipes, moves via said venting pipe towards said rising pipe thereby causing said amount of liquid to be split from said liquid coming from said liquid pond, said interface member thereafter pushes by means of said pressurised gas said amount of liquid from said rising pipe towards said reservoir, and wherein in a fourth phase said distribution device is brought back to said first operating position after that said rising pipe has been emptied from said liquid and said interface member is been brought back to said venting pipe. Since the distribution device is situated at the ground level, there are no working components inside the liquid pond. Due to the fact that during each first operation phase a well determined amount of liquid is sucked up, by creating a depression into the rising and venting pipe, the method becomes independent from the depth of the liquid pond. Indeed, the created depression induces a suction on the liquid present in the liquid pond, which suction is independent from the depth of the liquid pond. Once the amount of liquid has been sucked-up, this liquid, which is present in the rising and venting pipes, has to be brought towards the reservoir. For this purpose the pressurised gas and the interface member are used. By switching the distribution device in its second operating position, the pressurised gas is now supplied to the venting pipe in which the interface member is present. Consequently during the third phase the pressurised gas pushes on the liquid present in the venting pipe and on the interface member. As the latter is floatable on the liquid, it will not be pushed inside the liquid by the pressurised gas. Since the venting pipe issues into the rising pipe, the pressurised gas will thus push the liquid from the venting pipe into the rising pipe and the interface member will follow the liquid. Once the interface member has reached the rising pipe, the pressurised gas will push on the interface member, which on its turn will push on the liquid in the rising pipe. The interface member will cause the liquid amount now present in the rising pipe to be split from the liquid coming from the liquid pond, thereby limiting the quantity of liquid to be raised into the reservoir within the considered operation cycle. Since the rising pipe is in contact with the reservoir via the distribution device, the liquid pushed out of the rising pipe will on its turn be pushed towards the reservoir. Because the pressurised gas continues to be applied on the interface member, the latter will also continuously push on the liquid in the rising pipe, thereby pushing the latter into the reservoir until the rising pipe is emptied. The interface member is then brought back to the venting pipe during the fourth phase by the distribution device. In such a manner, within each cycle a well determined amount of liquid is each time extracted from the liquid pond and supplied to the reservoir. The fact that the amount of liquid is well determined and split from the liquid pond, allows to handle each time a limited amount of liquid and to avoid the use of high pressure for bringing the liquid to the reservoir.

A first preferred embodiment of a method according to the invention is characterised in that said rising and said venting pipe are at least partially located within an air tight primer tank in which their connection is situated, said air tight primer tank being in contact with the liquid inside the liquid pond, and wherein said venting pipe is provided with openings in its part, situated in said air tight primer tank, enabling a passage of said liquid and said pressurised gas between said air tight primer tank and said venting pipe, said air being also removed from said air tight primer tank and said tank being filled with liquid by said suction. Using an airtight primer tank enables to more efficiently use the available space within the bore connecting the pond to the ground level and thereby optimise the amount of suck-up liquid during each operation cycle. Since the venting pipe is provided with openings, the sucked-up liquid and the pressurised gas can freely circulate between the venting pipe and the airtight primer tank. As only the venting pipe is provided with openings, the liquid will, during the third phase, enter into the venting pipe in order to be pushed into the rising pipe. Following the liquid flow from the venting pipe, the interface member is guided by the connection between the venting and the rising pipes to forcefully enter the rising pipe at the lower end of the rising pipe. At this point the liquid column is supported by the interface member backed by the pressurised gas and is therefore split from the primer tank. The applied pressurised gas will reach the primer tank via the openings in the venting pipe thereby chasing the liquid from the tank to the venting pipe.

A second preferred embodiment of a method according to the invention is characterised in that said distribution device is provided with a sliding valve, said distribution device being connected with said pressurised gas supply source and said pump, said sliding valve being brought and maintained in said first operating position as long as a pressure inside said reservoir is higher than a predetermined threshold value, said sliding valve being brought from said first operating position towards said second operating position when a pressure decrease caused by the removal of air inside said reservoir has caused said pressure inside said reservoir to become lower than said predetermined threshold value. The use of a sliding valve, operated by the pressure difference inside the reservoir with respect to ambient pressure enables a well balanced method and device, and a synchronization of the different operating phases with each other.

A device according to the invention is characterised in that said venting pipe has an outlet connected to said rising pipe, said reservoir being airtight and connected to a distribution device by a first and a second connection pipe which are separated from each other, said distribution device comprising a sliding valve, provided for being brought into a first and a second operating position, wherein in said first operating position said distribution device connects said first connection pipe to a pump, provided for pumping air out of said reservoir and said second connection pipe to said rising and venting pipe, in order to connect said rising and venting pipe with said reservoir and pump air out of said rising and venting pipe via said reservoir, thereby creating a suction of said amount of liquid, in particular through a feeding pipe equipped with a one way valve and extending from said liquid pond towards said rising pipe, into said rising and venting pipe and wherein in a second operating position said distribution device connects said second pipe to said rising pipe and connects an inlet of said venting pipe to said pressurised gas supply source, said device further comprising an interface member, provided for being floatable on said liquid and movable within said venting and rising pipe, said interface member being further provided for being pushed via said venting pipe towards said rising pipe by means of said pressurised gas, in order to push said amount of liquid, present in said venting and rising pipe, towards said reservoir.

Preferably, said distribution device is provided with a set of channels for realising said connections. The use of channels enables a selective connection between the reservoir, the pump, the rising and the venting pipe at each phase of the operation cycle.

Preferably, said distribution device comprises a pressure chamber connected with said reservoir, said sliding valve being connected with a control mechanism, extending partially in said pressure chamber, said control mechanism being provided for controlling the displacement of said sliding valve by means of air pressure. The use of a pressure chamber enables to control the movement of the sliding valve.

The invention will now be described in more details with respect to the drawings, illustrating a preferred embodiment of the invention.

Figures 1, 2, 3:
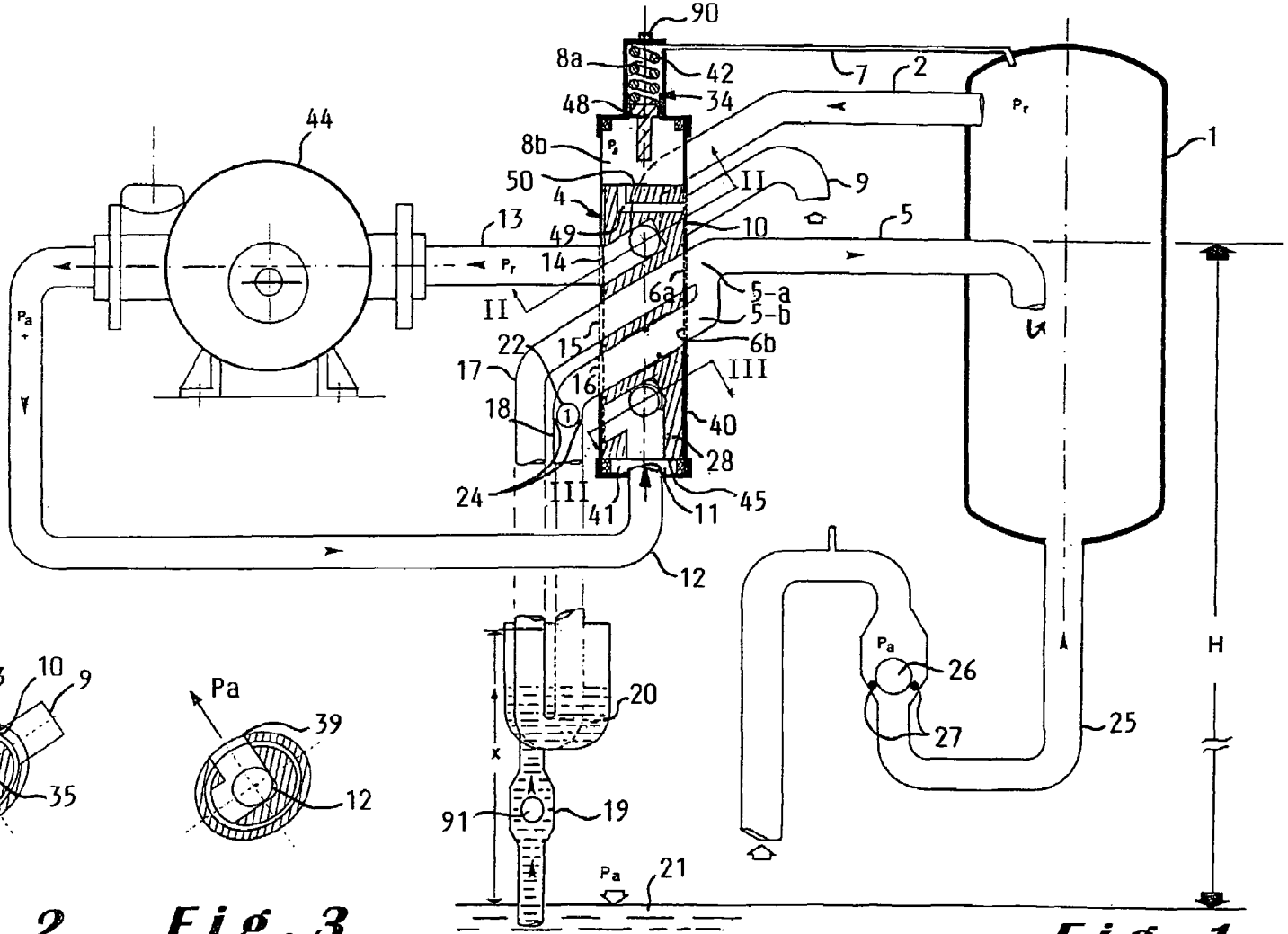
FIG. 1 illustrates the system according to the invention in the first phase of the operation cycle.
FIG. 2 shows a cross-section along the line II-II' in FIG. 1.
FIG. 3 shows a cross-section along the line III-III' in FIG. 1.

In the drawings, a same reference sign has been allotted to a same or analogous element.

FIG. 1 shows a preferred embodiment of a system for extracting a liquid, in particular water, from a liquid pond. In the further description only the example of water will be described, but it will be clear that the invention is not limited to the extraction of water and that other liquids, such as crude oil could be extracted using a same system and method. The system comprises an airtight reservoir 1, which capacity should be determined in function of the suction capacity of the system. The reservoir is connected via a first connection pipe 2 to a first inlet 3 (see FIG. 2) of a distribution device 4. The first connection pipe is preferably located in the upper part of the reservoir, since air has to be removed from the reservoir by using this first connection pipe as will be described hereinafter.

A second connection pipe 5, separated from the first connection pipe, also connects the reservoir 1 with the distribution device 4. The second connection pipe is connected with a second inlet 6 of the distribution device, which second inlet is situated lower than the first inlet and rotated with respect to the peripheral of the distribution device. In the FIGS. 1 and 2 this is illustrated by having the first inlet 3 on the backside and the second inlet 6 on the right lateral side. Preferably, the second connection pipe splits into two sub-branches 5*a* and 5*b* in the vicinity of the distribution device. Each sub-branch has its own second inlet 6*a* and 6*b* at the distribution device. A third connection pipe 7 connects the reservoir 1 with a pressure chamber 8, which is part of the distribution device 4. The third connection pipe is preferably situated in the upper part of the reservoir and has a smaller diameter as the first and second connection pipe. The third connection pipe realises a static link between the inside of the reservoir and the pressure chamber 8, in such a manner, that the pressure inside the reservoir and the pressure inside the pressure chamber correspond. An air inlet pipe 9 is connected with a third inlet 10 of the distribution device. The third inlet is preferably adjacent to the second inlet 6. Finally, the distribution device is provided with a fourth inlet 11 to which a duct 12 is connected. The fourth inlet is located in the under part of the distribution device and provides a direct connection with a further pressure chamber 41, situated in a bottom part of the distribution device. The function of this further pressure chamber is to balance the dead weight of a sliding valve 28 formed by a first piston, slidably mounted inside the distribution device.

A first outlet 14 of the distribution device 4 is connected via a duct segment 13 to an intake of a pressurised gas generator 44, in particular a compressor pump, which has an output connected to said duct 12. A second 15, respectively a third 16 outlet of the distribution device 4 is connected to a rising pipe 17, respectively a venting pipe 18. A fraction of the rising and venting pipe is located inside an airtight primer tank 20, where the venting pipe issues into the rising pipe. The airtight primer tank and/or the rising and venting pipe are connected to a feeding pipe 19, extending towards a liquid pond 21. The fraction of the venting pipe 18, located inside the airtight primer tank 20, has openings in its wall (illustrated by the dashed lines), in such a manner that the airtight primer tank can be filled with sucked up water, up to the same level than in the rising 17 and venting 18 pipes. The openings in the venting pipe preferably extend up to the connection with the rising pipe.

The airtight primer tank 20 is completely closed and is provided for being placed in the ground. Preferably the primer tank is designed for being placed inside the liquid pond, down to the water level in a standard borehole, so as to be in contact with the water. The rising 17 and venting 18 pipes cross however the upper face of the airtight primer tank in an airtight manner. Inside the airtight primer tank the venting pipe 18 joins the rising pipe 17, in such a manner, as to form an U-shaped connection. Preferably, the venting and rising pipe have a same inner diameter for a reason that will become clear hereinafter.

Inside the venting pipe 18, an interface member 22 is housed. This interface member is floatable on liquid and movable within the venting and the rising pipe. The interface member is preferably made of elastic material such as rubber or another synthetic elastic material and has a shape of a spherical ball when at rest. The elasticity of the interface member enables a deformation of its shape when pressure is applied on it, thereby facilitating its movement trough the venting and rising pipes. The elasticity of the interface member also enables a deformation of its shape when pressure is applied on it, thereby improving its function as a wad, when lifting the water in the rising pipe under the pressure of the gas, as will be described hereinafter. This elasticity brings the ball back to its spherical shape when there is no longer a pressure applied on it, as it is the case when the ball moves in the venting pipe, thereby saving energy while travelling within the venting pipe and allowing the same inside diameter for both venting and rising pipes. The ball shaped interface member avoids that the member remains blocked inside the venting and rising pipe due to picked material such as sand, which could be present in the sucked up liquid. The interface member acts as a wad inside the venting and rising pipes and its dimension has to be chosen in such a manner that the member fits inside the venting and rising pipes. In its rest position, the interface member rests on abutments 24, applied on the inner wall of the venting pipe.

Inside the feeding pipe 19 a conventional one-way valve 91 is mounted near the connection between the feeding and rising pipe and/or the air tight primer tank 20. This one-way valve is mounted in such a manner as to allow only a flow from the liquid towards the ground level. The one-way valve remains in its closed position during emptying of the airtight primer tank and/or the venting pipe.

A control mechanism 34 is mounted inside the pressure chamber 8 and comprises a second piston 48, forming the separation between a first 8*a* and a second 8*b* sub-chamber. The second piston is provided with an O-ring or another sealing ring in order to realise a gastight sealing between the first and second sub-chamber when the second piston is at rest. The second piston is movable within the first sub-chamber and spring loaded. This is realised by a spring 42 extending between an upper side of the second piston and an upper wall of the first sub-chamber. The force applied by the spring 42 is preferably adjustable by means of a setting screw 90 accessible for maintenance at the top of the first sub-chamber. As the first sub-chamber is connected to the reservoir via the third connection pipe 7, the pressure inside the first sub-chamber corresponds to the pressure inside the reservoir 1.

The sliding valve 28 further comprises an internal connection pipe 49, connecting an outer wall of the sliding valve with the second sub-chamber 8*b*. When the sliding valve is in its first operating position, as illustrated in FIG. 1, the air inlet pipe 9 and the internal connection pipe 49 face each other, so that ambient air can enter into the internal connection pipe and reach the second sub-chamber 8*b*.

The sliding valve 28 is preferably shaped as a freely movable cylindrical first piston mounted inside a cylindrical envelope formed by the housing of the distribution device and provided to be moved upwards and downwards inside the distribution chamber. For this purpose, the sliding valve is controlled by the control mechanism 34 mounted inside the pressure chamber 8. The first piston is provided with an upper side 50. The distribution device preferably extends vertically in such a manner as to allow gravity to exercise its force on the first piston and allow the dead weight of the first piston to balance the pressure applied at its extremities inside the cylindrical envelope.

The sliding valve 28 is further provided with a set of channels. A first channel 35 (FIG. 4) is situated in the upper part of the sliding valve. Underneath the first channel, a second 36 and a third 37 channel, as well as a fourth channel 38, are successively applied. The channels all extend substantially in parallel to each other and are not interconnected with each other inside the sliding valve.

The reservoir 1 is further connected to an outlet duct 25 in which an anti-return valve 26, 27 is mounted. The anti-return valve is preferably formed by a ball 26 resting on two abutments 27, which are mounted on the inner wall of the outlet duct.

As illustrated in FIGS. 1 and 2, during a first phase of an operation cycle, the first free piston of the sliding valve 28 is located in a first operating position at a downward position inside the distribution chamber 40 of the distribution device 4.

In this position (see FIG. 2), the first channel 35 connects the first inlet 3 with the first connection pipe 2 and the first outlet 14 with the duct segment 13. The second 36 and the third 37 channels connect the first sub-branch 5*a* and the second sub-branch 5*b* of the second connection pipe 5 via the second inlets 6*a* and 6*b* with the rising pipe 17 via the second outlet 15 and the venting pipe 18 via the third outlet 16. The fourth channel 38 is open to the lower end of the first piston and receives via the duct 12 the output of the pump 44 in all phases. In the first phase, as shown in FIG. 3, the output of the fourth channel 38 is in contact with ambient atmospheric pressure, through outlet 39.

In the first phase of the operating cycle, ambient air is present in the reservoir 1. Since the latter is connected via the third connection pipe 7 to the first sub-chamber 8*a* of the pressure chamber 8, that ambient air is also present in the first sub-chamber 8*a*. Via the air inlet pipe 9, ambient air reaches the internal connection pipe 49, thus causing air to enter into the second sub-chamber 8*b*. As on both sides of the second piston 48 ambient air is present, a same pressure is applied on both sides of the second piston, causing the latter to remain stationary. The pressure exerted on the first piston by the ambient air in the second sub-chamber 8*b*, keeps this first piston in its downward position.

To start up the suction of the water out of the underground liquid pond 21, the compressor pump 44 is switched on. The pump will now suck the air out of the reservoir 1 via the first connection pipe 2, the first channel 35 and the duct segment 13. The air pumped out the reservoir is compressed and supplied via the duct 12 to the fourth channel where it is exhausted in the ambient air via opening 39. The fact that air is sucked out of the reservoir will cause the anti-return valve 26, 27 to close, thereby avoiding that fresh air enters the reservoir.

The feeding pipe 19 can be either directly connected to the airtight primer tank 20, if any, or directly connected to the rising pipe 17. Since the venting pipe is perforated, the openings in the wall of the venting pipe enable not only a passage of liquid, but also a passage of air. So, the air present in the airtight primer tank 20 will be sucked out via those openings. This sucked-out air will then flow to the reservoir either via the venting pipe or via the rising pipe.

By pumping air out of the reservoir 1 as well as out of the venting and rising pipes and the airtight primer tank 20, a depression will be formed inside the reservoir. Since the reservoir is connected via the second connection pipe 5, the second 36 and third 37 channels to the rising pipe 17 and the venting pipe 18, the depression created inside the reservoir will also be created inside the venting 18 and the rising pipe 17 as well as in the airtight primer tank 20. The depression formed inside the reservoir 1, the air tight primer tank 20 as well as in the venting and rising pipe will now cause a suck up of water from the underground liquid pond 21 to the airtight primer tank and the rising and venting pipe. The use of the airtight primer tank 20 enables to suck up a larger quantity of water than would be the case if only the rising and the venting pipe would have been used.

The water will reach the airtight primer tank 20 either directly or via the openings in the venting pipe, depending on the chosen construction. The sucked-up water will fill the air tight primer tank and the sections of the venting and rising pipe, located inside the air tight primer tank. The amount of sucked-up water is determined by the distribution mechanism. Indeed, once the distribution mechanism will reach its second operating position, caused by air pressure difference, as described hereinafter, the suck-up of water will stop. This causes each time to suck up a substantial same amount of water and to suck up the water amountwise and not continuously.

Figure 4:
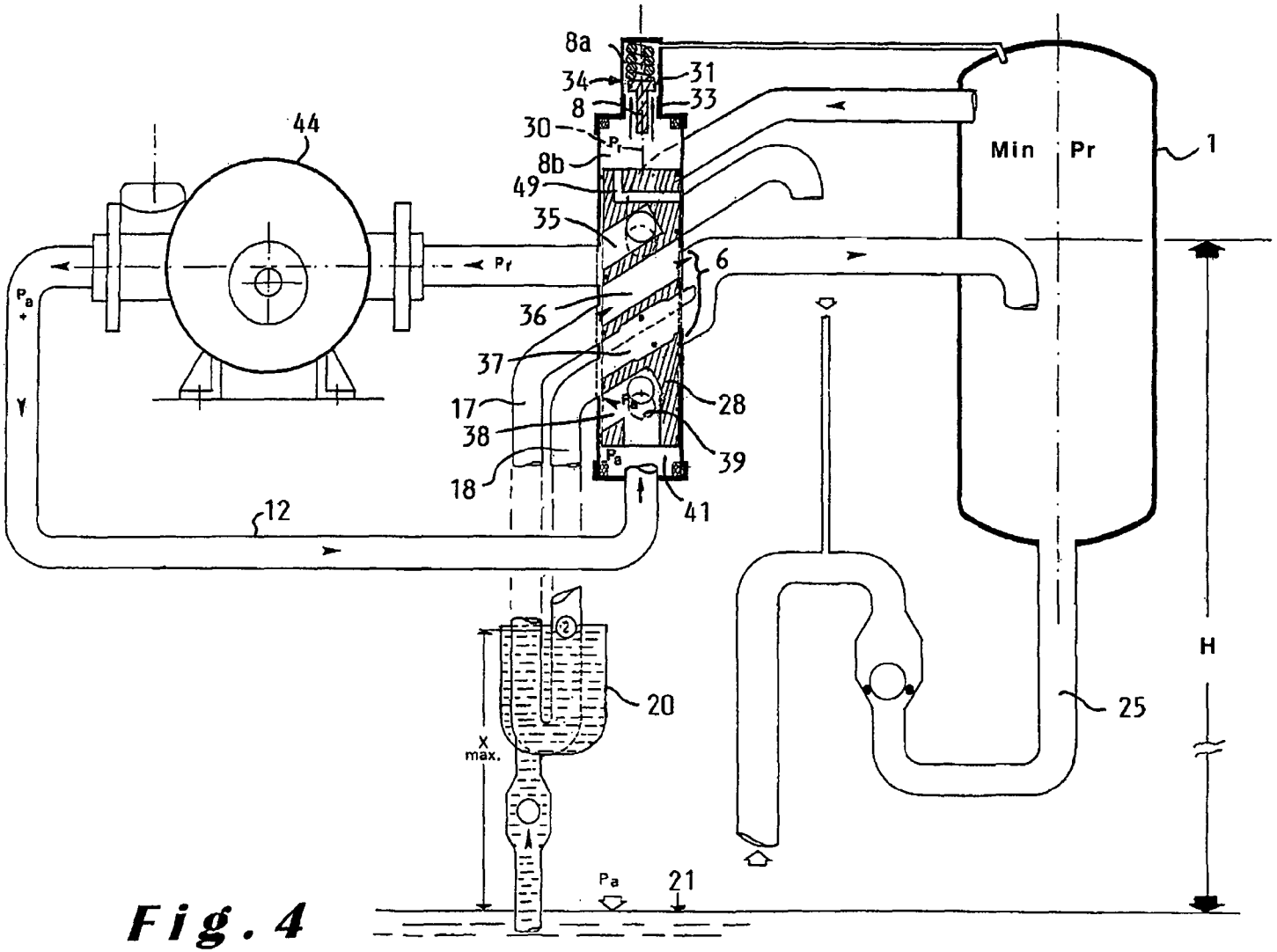
FIG. 4 shows the system in transition between the first and second phase.

As long as the compressor pump 44 continues to remove air from the reservoir 1, the pressure inside the reservoir will continue to fall down. But since the reservoir is connected via the third connection pipe 7 to the first sub-chamber 8*a*, the falling pressure inside the reservoir will also be felt inside the first sub-chamber 8*a*. As in the second sub-chamber 8*b* atmospheric pressure is still present via the internal connection pipe 49, the falling pressure within the first sub-chamber 8*a* will cause a pressure difference between the first and second sub-chamber. The second piston 48 will thus feel the atmospheric pressure on its lower surface, in contact with the second sub-chamber 8*b* and a pressure drop on its upper surface in contact with the first sub-chamber 8*a*. This pressure difference between the first and second sub-chamber will cause the second piston to move upwards inside the first sub-chamber, up to a point where the differential pressure on the second piston exceeds the setting of the spring 42. The spring will than be compressed by the pressure applied on the second piston. The upward movement of the second piston causes lateral passages along the second piston to open, allowing the air in the second sub-chamber 8*b* to leak towards the first sub-chamber and the reservoir. This results in a sudden differential pressure on both surface of the first piston. At this point, the sliding valve 28 is subjected to the differential pressure between its upper face 50 and its lower face 45. The atmospheric pressure, applied on the lower face 45, will exceed the pressure inside the reservoir and applied on the upper face, to the effect that the resulting force will overcome the dead weight of the first piston and the friction force caused by the sealing rings, in opposition of the upward motion, thereby causing the first piston to start an upward movement as illustrated in FIG. 4. The differential pressure value is settable via the setting screw 90, which enables on its turn to control the exerted suction on the water in the liquid pond and thus on the amount of water sucked up per cycle.

The lower face 45 of the sliding valve 28 feels the compressed air, supplied via duct 12 by the pump 44. As long as the sliding valve is in its first operating position, this pressurised air escapes via the fourth channel 38. However, as soon as the first piston starts its upward movement, the outlet 39 will gradually close, so that the compressed air can no longer escape via this outlet 39. In such a manner, the compressed air is pushing on the lower face 45 of the sliding valve, thereby contributing to the upward movement of the first piston. This upward movement will bring the sliding valve in its second operating position so that the second phase of the operating cycle can start. The upward movement of the sliding valve will also cause the internal connection 49 to be shifted away from the air inlet pipe 9, thereby no longer supplying ambient air to the second sub-chamber.

The basic function of the sliding valve 28 is to establish the connections between the different air and water ducts connected at the periphery of the external cylinder 40 of the distribution device. These connections are arranged in view of achieving the successive sucking-up and blowing phases, by shifting the first piston from a downward position to an upward position and back, as needed by the air and water flow conditions. To achieve this function, the set of channels of the first piston has a size and configuration will allow accurate connections with the outlets and inlets. To that end, the different channels are designed along a parallel axis, to match the two programmed piston positions.

Figures 5, 6, 7:
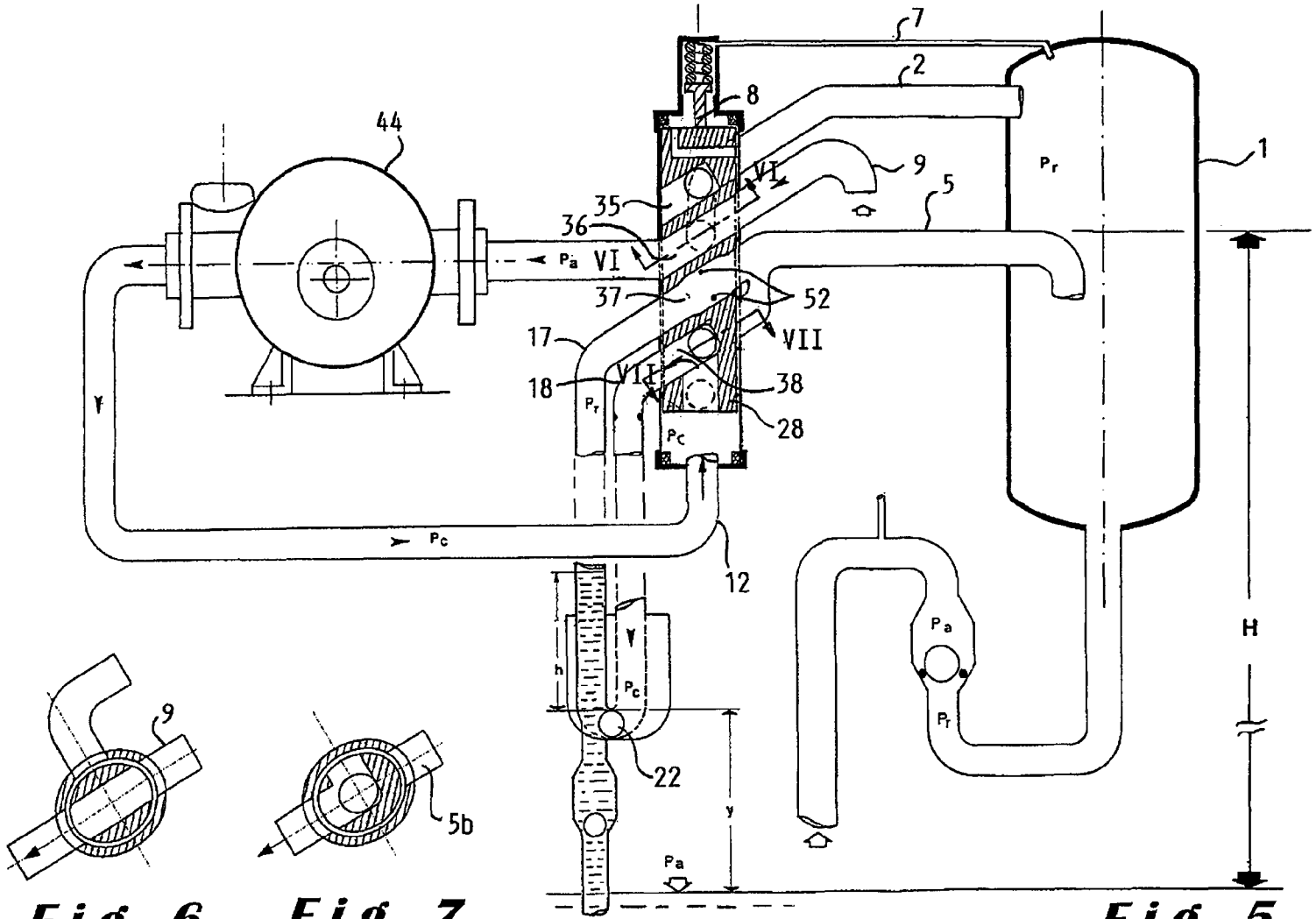
FIG. 5 shows the system in the second and in the beginning of the third phase of the operation cycle, FIG. 6 respectively 7 show a cross-section along the line VI-VI' respectively VII-VII' in FIG. 5.

As illustrated in FIG. 5, in the second phase the first channel 35 no longer connects the first connection pipe 2 to the pump. The latter is now connected via the second channel 36 to the air inlet pipe 9, as shown in FIG. 6. The third channel 37 connects the rising pipe 17 with the second connection pipe 5, whereas the fourth channel 38 connects the duct 12 to the venting pipe 18, in order to supply pressurised air to the venting pipe. The sliding valve 28 of the distribution device closes branch 5*b* of the second connection pipe 5.

It should be noted that instead of using the compressed air, generated by pump 44, it could also be possible to use a pressurised gas supply source when a pump is used, the latter being preferably a vacuum pump. The gas supply source could also be used for creating the depression in the reservoir.

In a third phase of the operating cycle, the compressor pump 44 pumps ambient air, input via the air inlet pipe 9. This ambient air is compressed and the pressurised air thus obtained is furnished via duct 12 and the fourth channel 38 to the venting pipe 18. The pressurised air will thus enter the venting pipe and exert a pressure on the water present in the venting pipe and push the interface member towards the water surface. The interface member 22 feels the pressurised air and, as it floats on the water, follows the movement of the water in the venting pipe. The pressurised air will push the water via the U-shaped connection towards the rising pipe 17. This pushing action will also cause the water, present in the airtight primer tank, to flow inside the venting pipe via the openings. Indeed, due to the fact that pressurised air is applied on the water, the latter is pushed through the venting pipe towards the rising pipe. By thus emptying the venting pipe, water can flow through the openings, thereby also emptying the airtight primer tank.

When the interface member reaches the bottom of the U-shaped connection between venting and rising pipe, it will split the water column coming either from the feeding pipe 19 or from the airtight primer tank. As the compressed air is applied on the interface member 22, the latter will apply a pressure on the water in the rising pipe, thereby pushing the water from the rising pipe towards the third channel 37 in order to reach via the second connection pipe the reservoir 1, where the water is collected. The fact that now the pressurised air is no longer directly applied on the water, but via the interface member, will prevent that pressurised air is blown in the water, as it is the case with the air lift method, during the upward movement of the water in the rising pipe. The interface member thus acts as an interface between the pressurised air and the upward moving water column.

Once the sucked-up amount of water has been pushed inside the reservoir by means of the interface member, the latter is stopped inside the third channel 37 by means of an arresting grid 52. When the volume of the water supplied to the reservoir 1 has reached a certain level, the pressure applied by the water on the anti-return valve 26, 27 will be sufficient to open the latter (see FIG. 8), thereby draining the reservoir and supplying the water to a distribution network 43.

Figure 10:
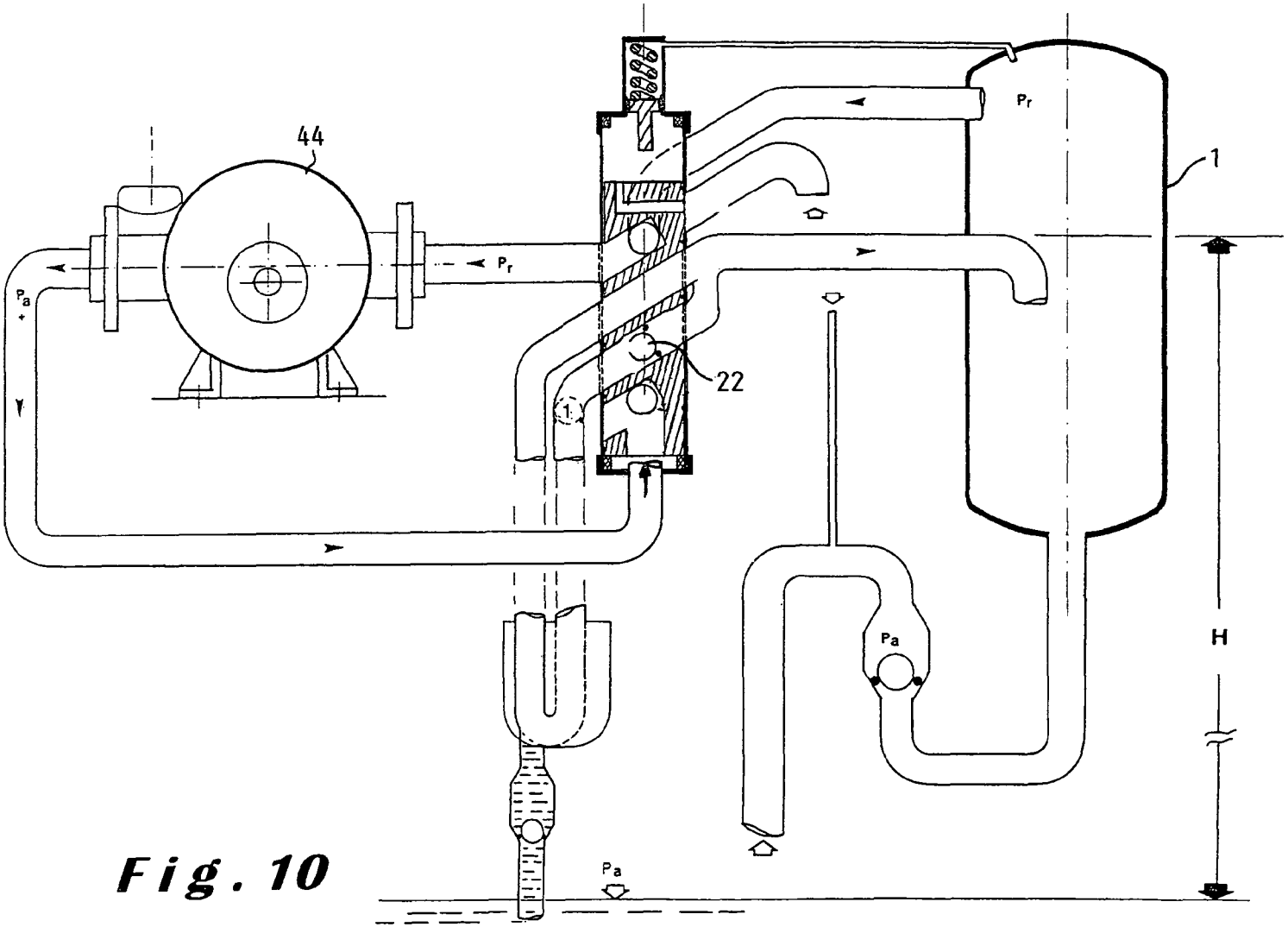
FIG. 10 shows the system in the final phase of the operation cycle.

Once the reservoir is emptied, air is supplied to the latter and the initial situation will be restored, causing the distribution device to return in a final phase to its downward position as illustrated in FIG. 10. The supply of air to the reservoir will on its turn cause to start the fourth phase of the operating cycle where, due to the pressure applied in the first sub-chamber 8*a*, the sliding valve will be brought back to its first operating position. Indeed, by applying air inside the first sub-chamber, the second piston 48 will move downwards, thereby helped by the force of the spring 42 returning to its rest position. The second piston will then exert a force on the sliding valve causing the latter to move downwards. As this movement will cause the outlet 39 to open, the pressurised air, applied on the lower face of the sliding valve will escape through this outlet 39, thereby no longer holding the sliding valve in its upward position. Of course gravity will help the sliding valve in its downward movement.

Since the interface member 22 is present in the third channel, the downward movement of the sliding valve will cause the downward movement of the third channel, thereby positioning the interface member in front of the venting pipe inlet, which is connected to the third channel when the distribution member is in its first operating position.

Figure 8:
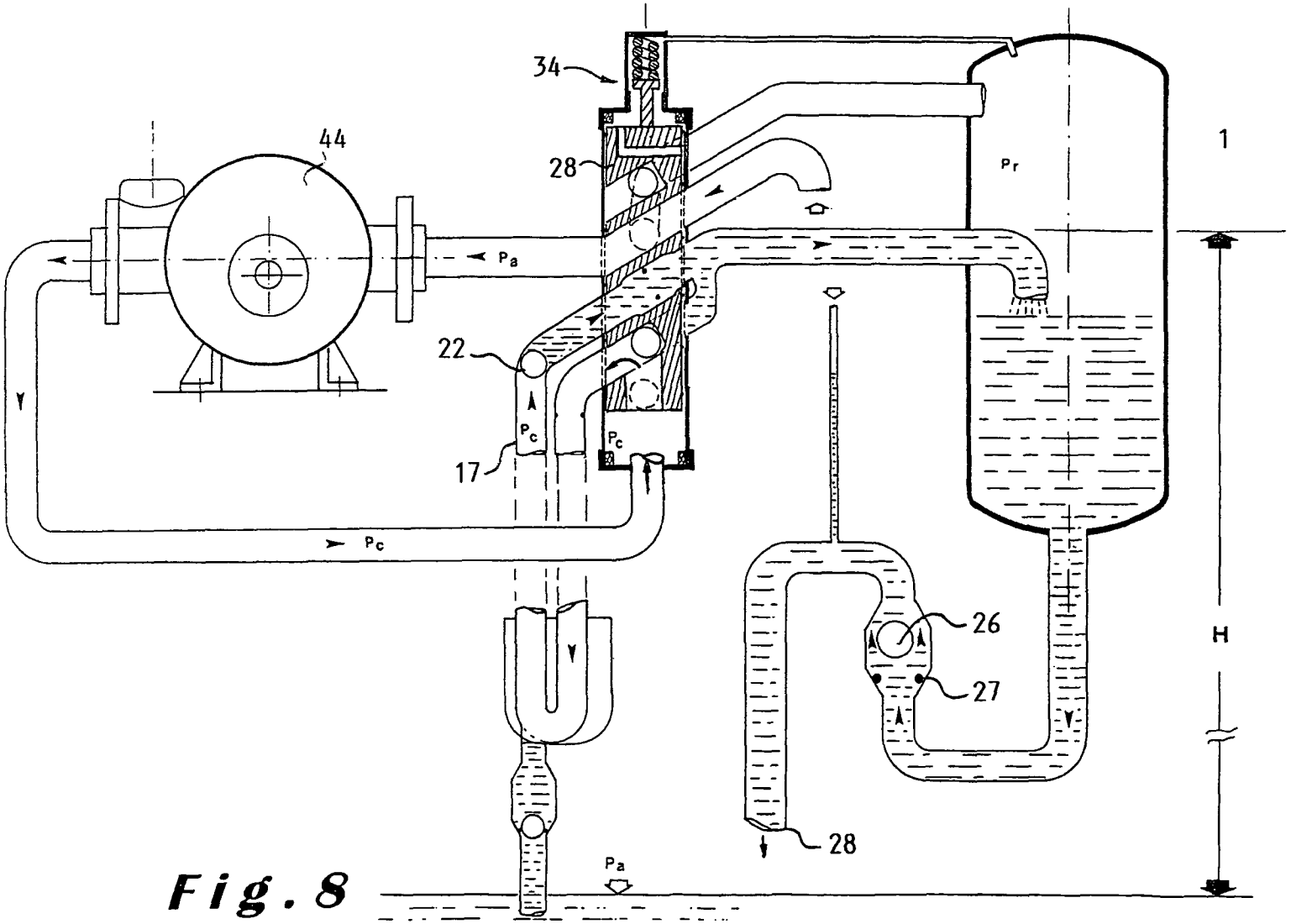
FIG. 8 shows the system during the third phase of the operation cycle.
Figure 9:
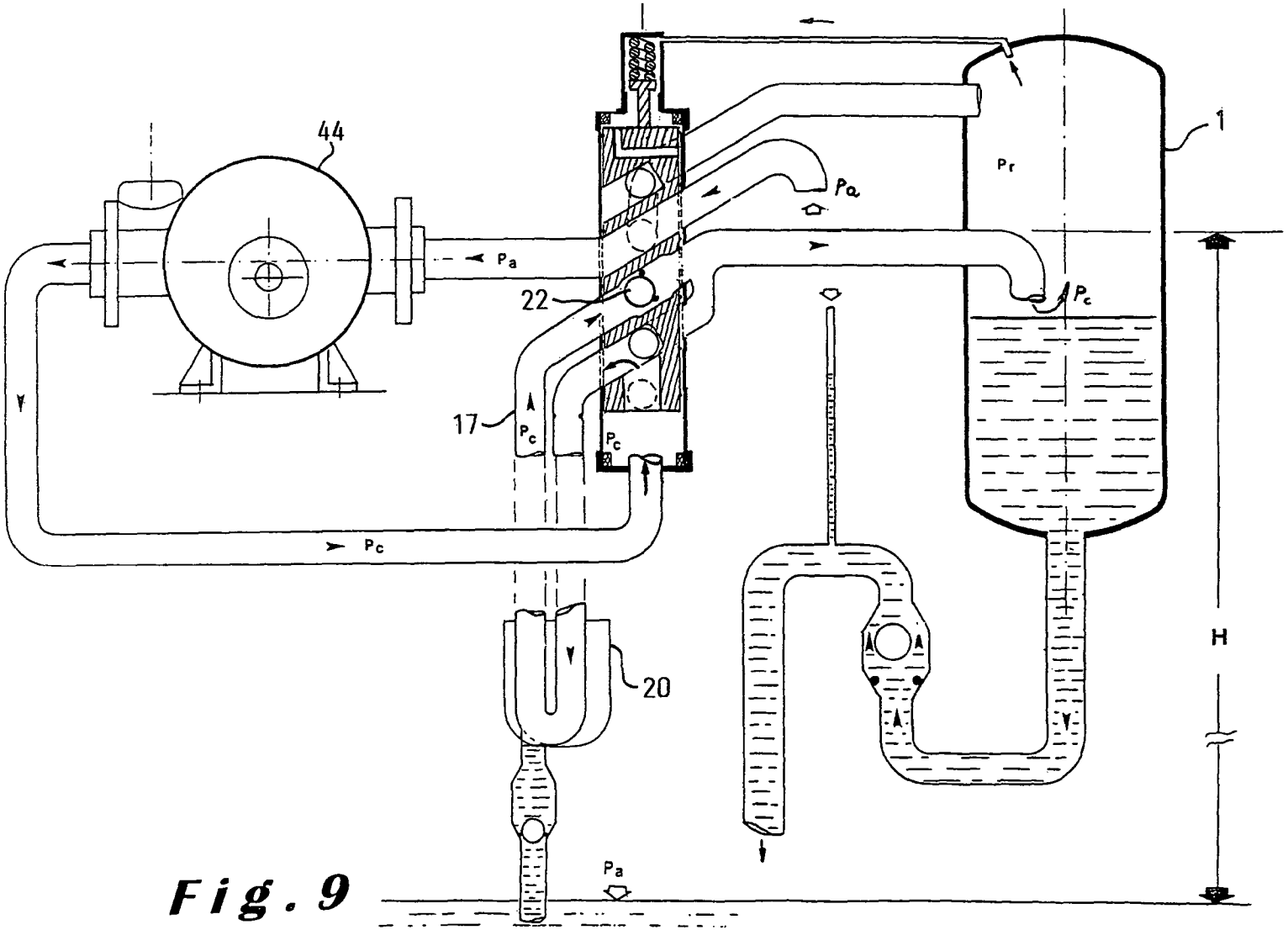
FIG. 9 shows the system in the beginning of the fourth phase of the operation cycle.

An important function of the piston channel 37 is to prevent the interface member from entering the reservoir 1 when pushing the water towards the reservoir, as shown by the interface member successive positions in FIGS. 8 and 9. To this end, the arresting grid allows the water and air flow to flow towards the reservoir, while preventing the interface member from moving further. It is understood that the air pressure is still applied to the interface member, holding it against the grid until the sliding valve will drop, to start the next cycle. At this point, the interface member will fall back by gravity in the venting pipe, as shown in FIG. 10. The angular orientation of channel 37 is intended to provide a gravity vector on the interface member to induce its backwards motion. In such a manner the interface member is brought back to the venting pipe by the downward movement of the sliding valve and ready for use in a subsequent operating cycle.

The pump 44, the reservoir 1 and the distribution device are all placed on or above the ground level, thereby avoiding that they have to be placed inside the liquid pond. Only the static suction device is installed at the bottom of the liquid pond.

It should further be mentioned that due to gravity, draining the water in the airtight reservoir, will help the pump 44 to create the depression in the first phase in a siphon-like manner. To take advantage from this effect, together with the supply to the water network, a preferred installation of the airtight reservoir should be set on top of a derrick structure at some 12 meters above the ground level.

The invention claimed is:

1. A method for raising liquid from a pond, the method comprising:

providing a distribution device connected between a pressurised gas generator and an air-tight reservoir;

providing a venting pipe and a rising pipe connected between the distribution device and a feeding pipe, which feeding pipe extends from the pond and comprises a check valve;

providing a first and a second connection pipe, each for connecting the distribution device to the reservoir; and providing a buoyant interface member, initially situated in the venting pipe and movable between the venting pipe and the rising pipe and the distribution device; wherein the method further comprises a first phase in which the distribution device operates at a first operating position, wherein the reservoir, the rising pipe and the venting pipe are in a first configuration separately connected to the distribution device, which first configuration allows evacuation of air from within the reservoir, the venting pipe and the rising pipe, enabling suction of a liquid amount from the pond, through the feeding pipe and into the venting pipe and the rising pipe;

a second phase in which the distribution device operates at a second operating position, wherein the reservoir is connected to the rising pipe and the venting pipe is connected to the pressurised gas generator in a second configuration, which second configuration allows the pressurised gas generator to supply pressurised gas into the venting pipe;

a third phase in which the pressurised gas entering the venting pipe pushes the interface member into the rising pipe, the interface member pushing a portion of the liquid amount toward the reservoir through the second connection pipe; and;

a fourth phase in which the portion of the liquid amount enters the reservoir, the distribution device returns to the first operating position, and the interface member returns to the venting pipe.

2. The method as claimed in claim 1, wherein a portion of the venting pipe and a portion of the rising pipe are located within an air-tight primer tank, in which primer tank a connection between the rising pipe and the venting pipe is situated, the primer tank in fluid communication with liquid in the pond, and wherein the portion of the venting pipe situated in the primer tank is provided with pipe wall openings enabling passage of liquid and air between the primer tank and the venting pipe.

3. The method as claimed in claim 1, wherein the distribution device is provided with a sliding valve, the sliding valve moving towards and remaining in the first position as long as pressure inside the reservoir is higher than a predetermined threshold value, the sliding valve moving from the first position towards the second position when a pressure decrease, caused by the evacuation of air inside the reservoir, causes the pressure inside the reservoir to become lower than the predetermined threshold value.

4. The method as claimed in claim 1, wherein the check valve is in a closed position during the second phase and the third phase.

5. The method as claimed in claim 1, wherein the pressurised gas is generated by air removed from the reservoir.

6. A system for raising a liquid from a pond, the system comprising:

a pressurised gas generator;

an air-tight reservoir;

pumping means;

a distribution device connected between the pressurised gas generator and the reservoir, which distribution device comprises a sliding valve that is provided to cycle between a first and a second operating position;

a venting pipe and a rising pipe connected between the distribution device and a feeding pipe, which feeding pipe is provided to be extended into the pond and comprises a check valve;

a first and a second connection pipe, each connecting the distribution device to the reservoir; and a buoyant interface member, situated in a rest position in the vending pipe and movable between the venting pipe and the rising pipe;

wherein, when the sliding valve is at the first operating position, the pumping means evacuates air through the first connection pipe from the reservoir, reducing a pressure inside the reservoir, the venting pipe and the rising pipe, the reduced pressure inducing liquid to collect into the venting pipe and the rising pipe from the feeding pipe, the liquid forming a liquid amount within the rising and feeding pipe;

wherein, when the sliding valve is at the second operating position, the pressurised gas generator causes pressurised gas to enter the venting pipe and pushes the interface member into the rising pipe, the interface member pushing a portion of the liquid amount toward the reservoir through the second connection pipe, the portion of the liquid amount eventually entering the reservoir, after which the sliding valve returns to the first operating position and the interface member returns to the venting pipe.

7. The system as claimed in claim 6, wherein a portion of the venting pipe and a portion of the rising pipe are located within an air-tight primer tank, in which primer tank a connection between the rising pipe and the venting pipe is situated, the primer tank in fluid communication with the liquid inside the pond, and wherein the portion of the venting pipe situated in the primer tank is provided with pipe wall openings, enabling a passage of liquid and air between the primer tank and the venting pipe.

8. The system as claimed in claim 6, wherein the distribution device is provided with a set of channels.

9. The system as claimed in claim 8, wherein the channels of the set of channels extend substantially parallel to each other.

10. The system as claimed in claim 6, wherein the distribution device further comprising a pressure chamber connected with the reservoir, the sliding valve being connected with a control mechanism extending partially into the pressure chamber, the control mechanism being provided for controlling the displacement of the sliding valve by means of air pressure.

11. The system as claimed in claim 10, wherein the pressure chamber comprises a first sub-chamber connected via a third connection pipe to the reservoir and a second sub-chamber having an access connectable to ambient air, the control mechanism comprising a piston movably mounted in the first and second sub-chamber.

12. The system as claimed in claim 11, wherein the piston is spring-loaded.

13. The system as claimed in claim 6, wherein the interface member is made of elastic material.

14. The system as claimed in claim 6, wherein the interface member is ball-shaped.

15. The system as claimed in claim 6, wherein the sliding valve is shaped as a cylindrical piston, which is freely movable within the distribution device.

* * * * *